US007500390B2

(12) United States Patent
Mills

(10) Patent No.: US 7,500,390 B2
(45) Date of Patent: Mar. 10, 2009

(54) METHOD FOR ESTIMATING PUMP EFFICIENCY

(75) Inventor: Thomas M. Mills, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 468 days.

(21) Appl. No.: 11/172,214

(22) Filed: Jun. 29, 2005

(65) Prior Publication Data

US 2007/0020110 A1 Jan. 25, 2007

(51) Int. Cl.
*F04B 51/00* (2006.01)

(52) U.S. Cl. ..... 73/152.61

(58) Field of Classification Search ..... 73/152.61; 417/53

See application file for complete search history.

(56) References Cited

U.S. PATENT DOCUMENTS

| | | | | |
|---|---|---|---|---|
| 3,343,409 | A | 9/1967 | Gibbs | |
| 3,998,568 | A | 12/1976 | Hynd | |
| 4,034,808 | A | 7/1977 | Patterson | |
| 4,118,148 | A * | 10/1978 | Allen | 417/12 |
| 4,490,094 | A | 12/1984 | Gibbs | |
| 5,252,031 | A | 10/1993 | Gibbs | |
| 5,631,859 | A | 5/1997 | Markstein et al. | |
| 6,640,896 | B1 * | 11/2003 | Zheng | 166/250.15 |
| 7,168,924 | B2 | 1/2007 | Beck et al. | |

FOREIGN PATENT DOCUMENTS

| | | |
|---|---|---|
| EP | 0 997 608 | 5/2000 |
| WO | WO 93/02289 | 2/1993 |

OTHER PUBLICATIONS

GB Search Report, Application No. 0612766.6, Dated Oct. 26, 2006.

Everitt, T.A., et al., "An Improved Finite-Difference Calculation of Downhole Dynamometer Cards for Sucker-Rod Pumps", SPE 18189, SPE Production Engineering, Feb. 1992, pp. 121-127 with 5 pages of enlarged Tables and Figures.

Ray, Louis I., "Using Downhole Displacement and Inferred Production for Verification of Measured Test Data", SPE 62540, presented at the 2000 SPE/AAPG Western Regional Meeting held in Long Beach, California, Jun. 19-23, 2000, pp. 1-10.

* cited by examiner

*Primary Examiner*—John Fitzgerald
(74) *Attorney, Agent, or Firm*—Patterson & Sheridan, L.L.P.

(57) ABSTRACT

The present invention provides highly accurate methods for directly calculating pump fillage which avoid the need and expense of a pump dynamometer card and subsequent calculations.

24 Claims, 2 Drawing Sheets

Timesteps (j)

1 2 3 . . . . . η

Nodes (i)

0 u u u

METHOD FOR ESTIMATING PUMP EFFICIENCY

BACKGROUND OF THE INVENTION

1. Field of the Invention

Embodiments of the present invention generally relate to methods for estimating efficiency and controlling the operation of a downhole pump. More particularly, embodiments of the present invention generally relate to methods for estimating efficiency and controlling the operation of a conventional sucker-rod pump.

2. Description of the Related Art

The production of oil with a sucker-rod pump such as that depicted in FIG. 1 is common practice in the oil and gas industry. The sucker-rod pump 100 is driven by a motor 110 that turns a crank arm 120. Attached to the crank arm 120 is a walking beam 130 and a Horsehead 140. A cable 150 hangs off the Horsehead 140 and is attached to a sucker-rod 155. The sucker-rod 155 is attached to a downhole pump 160 located within the wellbore 165. A portion of the sucker-rod 155 passes through a stuffing box 170 at the surface. That portion of the sucker-rod is called the polished rod 175. In operation, the motor 110 turns the crank arm 120 which reciprocates the walking beam 130 which reciprocates the sucker-rod 155.

The downhole pump 160 includes a barrel 180 that can be attached to or part of the production tubing 185 within the wellbore 165. A plunger 187 is attached to the end of the sucker-rod 155 and reciprocates in the barrel 180. The barrel 180 includes a standing valve 190. The plunger 187 is provided with a traveling valve 195. On the up stroke of the plunger 187, the traveling valve 195 closes and the fluid is lifted above the plunger 187 to the top of the well, and the standing valve 190 opens to allow additional fluid from the wellbore 165 into the barrel 180. On the down stroke of the plunger 187, the traveling valve 195 opens and the standing valve 190 closes, allowing the plunger 187 to pass through the fluid which is being held in the barrel 180 by the standing valve 190.

Typically, the pumping system is designed with the capacity to remove liquid from the wellbore 165 faster than the reservoir can supply liquid into the wellbore 165. As a result, the downhole pump does not completely fill with fluid on every stroke. The well is said to be "pumped-off" when the pump barrel 180 does not completely fill with fluid on the upstroke of the plunger 187. The term "pump fillage" is used to describe the percentage of the pump stroke which actually contains liquid.

Varying degrees of mechanical damage can occur to the pumping system if the pump is operated with substantially less than 100% pump fillage for extended periods of time (i.e. when the well is pumped-off). During pumped-off conditions, the plunger contacts the fluid in an incompletely filled barrel at which point the traveling valve will open. The impact between the plunger 187 and fluid known as "fluid pound" will cause a sudden shock to travel through the sucker-rod 155 and the pumping unit 100 which can cause damage to the sucker-rod 155 and other pumping components. Thus, an effort is made to shut down the pumping unit when the well reaches a pumped-off condition to prevent damage to the equipment as well as to save power.

Automation devices have been used with sucker-rod pumping systems to monitor and temporarily discontinue pumping operations to protect the pump. Surface dynamometer data have long been used as a basis for controlling sucker-rod pumping systems. Historically, measured operating characteristics of the pumping unit have been used to derive a data set representing load (force) on the polished rod vs. displacement of the polished rod (known as a "surface dynamometer card"). Various algorithms have subsequently been applied to these data sets to identify a "pump-off" condition.

However, the surface dynamometer card does not supply an accurate depiction of the operation of the downhole pump due to the elasticity of the sucker-rod string and viscous damping effects among other operating conditions. With longer sucker-rods and larger pump sizes (higher stress) and even revolutionary new sucker-rod materials, the differences between the displacement versus time at the surface and the displacement versus time at the downhole pump can be quite dramatic. Therefore, methods of controlling sucker rod pumping units based upon surface dynamometer cards can be prone to error. In addition, the elasticity of the sucker rod string causes the stroke length of the downhole pump to differ from the stroke length of the polished rod. This introduces further error into production volume estimates.

Therefore, measurements taken at the pump are more reliable and less prone to error. Since direct measurement of the load and displacement at the pump in the wellbore is cost prohibitive in most production operations, attempts have been made to mathematically model or infer "downhole dynamometer cards" (load vs displacement at the downhole pump) from the surface dynamometer card and other static data. Those models are capable of providing an approximation of the actual downhole dynamometer card. However, the execution of those models in a remote setting (i.e. at the well site) requires considerable computing capacity. Additional logic must also still be applied to make a pump-off determination once the downhole dynamometer card has been mathematically simulated. Furthermore, existing methods including downhole dynamometer cards provide no direct means of estimating pump fillage. As a result, still more computational effort is required to derive the information needed to support reliable estimates of pump production.

There is a need, therefore, for a method for determining pump fillage and a method for controlling pump operations without deriving a downhole dynamometer card.

SUMMARY OF THE INVENTION

Methods for estimating pump efficiency of a rod pumped well are provided. In at least one embodiment, the method provides a rod within the well where the rod is connected to a pumping unit at a first end thereof and a pump at a second end thereof. The pumping unit is located at the surface. The rod reciprocates within the well by the pumping unit. A load on the polished rod and displacement of the polished rod are determined at a plurality of times during a single stroke of the pumping unit. The rod loads and displacement at the plurality of times are utilized to calculate at least one displacement and time near the pump. The calculated displacement and time near the pump are utilized to determine a minimum stroke (NS, feet) and maximum stroke (XS, feet). The calculated displacement and time near the pump are also used to calculate a transfer point (TP). From the minimum stroke (NS, feet), maximum stroke (XS, feet), and transfer point (TP), the pump efficiency (PEFF) can be calculated according to the following equation: $PEFF=100\%*(TP-NS)/(XS-NS)$.

In at least one other embodiment, the method provides a rod within the well where the rod is connected to a pumping unit at a first end thereof and a pump at a second end thereof. The pumping unit is located at the surface. The rod reciprocates within the well by the pumping unit. A load on the polished rod and displacement of the polished rod are determined at a plurality of times during a single stroke of the pumping unit. The rod loads and displacements at the plurality of times are used to determine a minimum stroke (NS, feet) and maximum stroke (XS, feet) near the pump. The rod loads and displacements at the plurality of times are also used to calculate a change in rod displacement versus change in time near the pump and a change in rod displacement versus change in depth near the pump. The calculated change in rod displacement versus change in time near the pump and the change in rod displacement versus change in depth near the pump are used to calculate a transfer point (TP). From the calculated minimum stroke (NS, feet), maximum stroke (XS, feet), and transfer point (TP), a pump efficiency (PEFF) can be calculated according to the following Equation: PEFF=100%*(TP−NS)/(XS−NS).

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 2 is a graphical illustration of a matrix of displacement versus time and depth.

DETAILED DESCRIPTION

Figure 1:
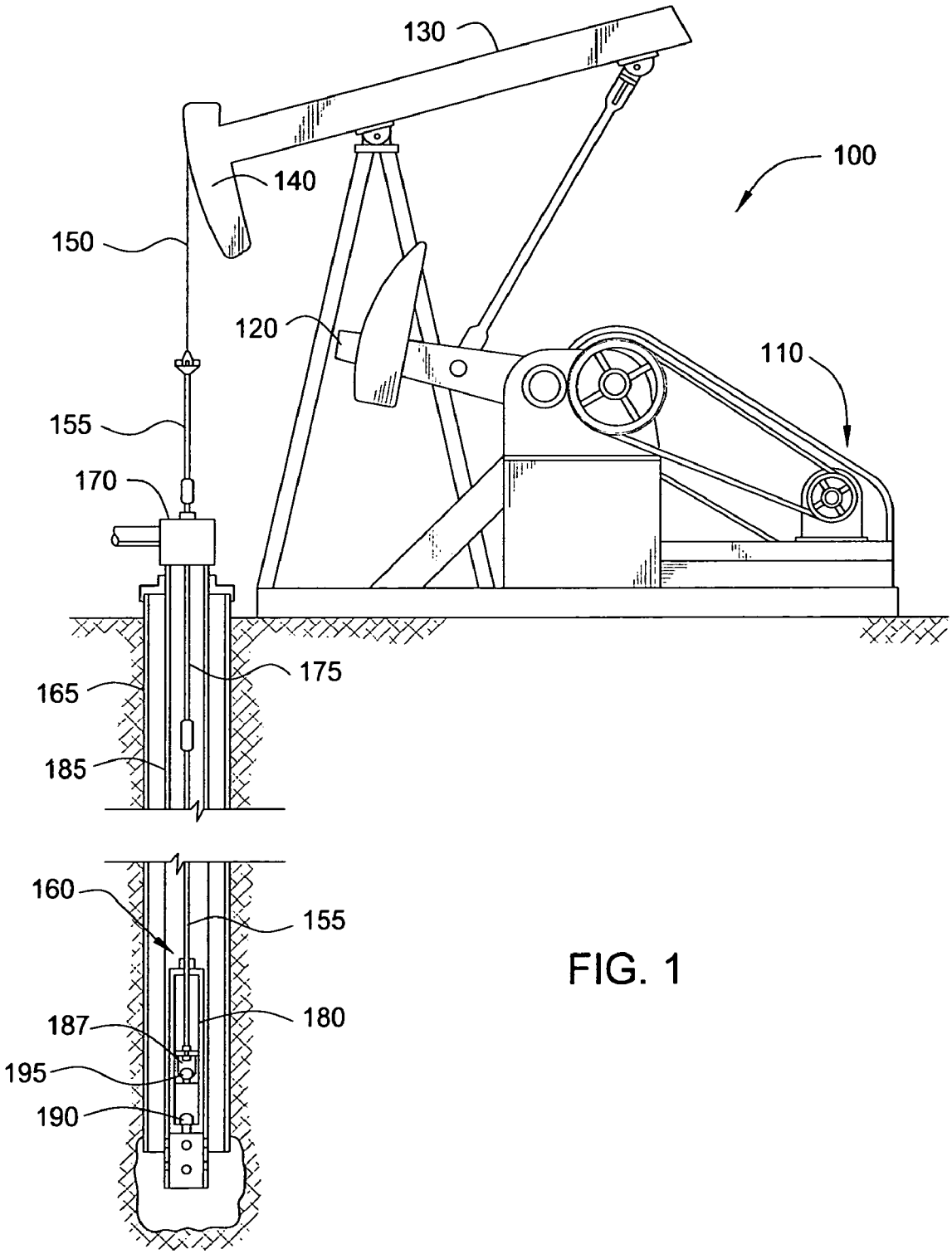
FIG. 1 is schematic depiction of an illustrative sucker-rod pumping unit.

Methods are provided that utilize a more direct approach to determining pump fillage which reduces processing requirements for wellsite devices and provides more precise estimates of pump fillage. In one or more embodiments, the methods calculate pump fillage directly from load and displacement data measured at the surface or determined from other measurements at the surface, rendering the calculation of load (i.e. force) at the pump unnecessary. In one or more embodiments, a finite-difference algorithm can be used to calculate rod displacement vs. time at the pump and rod displacement vs. depth at the pump. That information can be used to identify the minimum and maximum displacement at the pump as well as the pump displacement at precisely the time when load transfers from the traveling valve to the standing valve. The result is an accurate estimate of rod pump production and pump "fillage," without the time and expense required to calculate a traditional downhole card. The term "pump fillage" as used herein refers to the ratio of the net fluid stroke to downhole stroke expressed in percent.

The term "pump" as used herein refers to any downhole reciprocating pump. Preferably, the term "pump" refers to a sucker-rod pump such as the pump shown in FIG. 1. While a conventional beam pumping unit is shown in FIG. 1, the method is applicable to any system that reciprocates a rod string including tower type units which involve cables, belts, chains, and hydraulic and pneumatic power systems.

The term "net fluid stroke" as used herein refers to the measure of the portion of the downhole stroke during which the fluid load is supported by the standing valve. The net fluid stroke can be expressed in feet.

The term "downhole stroke" as used herein refers to the measure of extreme travel of the rod derived at the location of the pump. In other words, the term "downhole stroke" refers to the maximum displacement minus the minimum displacement, and corresponds to the horizontal span of a downhole card.

The method can function in a "closed loop" automated environment with no human interaction. Preferably, the method can be incorporated in a wellsite Rod Pump Controller (RPC) to control (e.g. stop or change the speed of) the pumping unit and accurately estimate fluid production from the well using rigorous (stroke-by stroke) analysis of the net fluid stroke. For example, the speed of the pumping unit can be varied when the pump efficiency falls below a preset amount. Particularly, the uphole stroke speed of the pumping unit can be varied when the pump efficiency falls below a preset amount. Additionally, a tubing leak can be detected when the average production rate exceeds a preset amount.

In one or more embodiments, the displacement and load data can be used to determine one or more characteristics of the downhole pump operation, such as the minimum pump stroke, maximum pump stroke, and transfer point in the downhole stroke. The "transfer point" for the downhole stroke is the displacement in the downhole stroke where load is transferred from the traveling valve to the standing valve. This transfer occurs because the pressure in the pump barrel has exceeded the pressure in the plunger. The portion of the stroke below (with lower displacement than) the transfer point can be interpreted as the percentage of the pump stroke which contains liquid.

In one or more embodiments, the displacement and load data can be measured (or determined) at the surface. For example, the motor speed and the displacement of the polished rod can provide a series of motor speed and displacement data pairs at a plurality of displacements along the polished rod. That displacement data which represents a complete stroke of the pumping unit can then be converted to load on the rod string and displacement of the rod string at a plurality of displacements along the polished rod, as described in U.S. Pat. No. 4,490,094.

In one or more embodiments above or elsewhere herein, the degree of rotation of the pumping unit crank arm can provide displacement data. For example, a sensor can determine when the pumping unit crank arm passes a specific location, and a pattern of simulated polished rod displacement versus time can be adjusted to provide an estimate of polished rod positions at times between these crank arm indications.

In one or more embodiments above or elsewhere herein, the degree of inclination of the pumping unit can provide displacement data. For example, a device can be attached to the pumping unit walking beam to measure the degree of inclination of the pumping unit.

In one or more embodiments above or elsewhere herein, the load data can be directly measured. For example, a load cell can be inserted between the polished rod clamp and the pumping unit carrier bar.

In one or more embodiments above or elsewhere herein, the strain on the pumping unit walking beam can provide load data. In one or more embodiments above or elsewhere herein, the amplitude and frequency of the electrical power signal applied to the motor can be used to determine motor rotation (i.e. displacement data) and motor torque (i.e. load data).

The polished rod loads and displacement data can then be used to calculate at least one displacement and time near the pump. In one or more embodiments, a finite-difference method for solving a one dimensional wave equation can be used to determine the displacements at time near the pump. An illustrative wave equation can be represented by Equation (1) as follows:

$$v^2\frac{\partial^2 u}{\partial x^2}=\frac{\partial^2 u}{\partial t^2}+c\frac{\partial u}{\partial t}, \quad (1)$$

where $v=\sqrt{144Eg_c/\rho}$

Equation 1 assumes a rod with a constant diameter. Multiplying Equation (1) by ($\rho A/44g_c$) modifies the wave equation to account for variable rod diameters, and provides a modified wave equation (Equation (2)) as follows:

$$EA\frac{\partial^2 u}{\partial x^2}=\frac{\rho A}{144g_c}\frac{\partial^2 u}{\partial t^2}+c\frac{\rho A}{144g_c}\frac{\partial u}{\partial t} \quad (2)$$

Finite differences can then be used to obtain a numerical solution for the wave equations. For example, the sucker-rod string can be divided into "finite elements," and Taylor series approximations can be used to generate finite-difference analogs for the derivatives of displacement that appear in the wave equation. Substituting the Taylor series approximations into Equation (2) gives Equation (3) as follows:

$$u_{i+1,j}=\{[\alpha\{1+c\Delta t)]u_{i,j+1}-[\alpha(2+c\Delta t)-(EA/\Delta x)^{+}-(EA/\Delta x)^{-}]u_{i,j}+\alpha u_{i,j-1}-(EA/\Delta x)^{-}u_{i-1,j}\}/(EA/\Delta x)^{+} \quad (3)$$

$$\text{where } \alpha=\frac{\overline{\Delta x}}{\Delta t^2}\left[\frac{(\rho A/144g_c)^{+}+(\rho A/144g_c)^{-}}{2}\right]$$

Equation (3) transmits the surface displacement downhole by calculating displacements at each node along the rod string until the last node just above the pump is reached. The polished rod loads at each displacement ($u_{0,j}$) can be used to start the solution. The displacements at $u_{1,j}$ can be calculated using Hooke's law in the form of Equation (4) as follows:

$$F=EA(\partial u/\partial x) \quad (4)$$

FIG. 2 is a graphical illustration that shows a matrix of displacement versus time and depth. FIG. 2 shows the displacements at each node along the rod string until the last node just above the pump (i.e. "the last rod section"). "Node 0" represents the displacement versus time data at the surface and "Node m" represents the displacement versus time data of the section just above the pump. The displacement limits of the last rod section ($U_{MIN}$ and $U_{MAX}$) can be determined from the matrix. The displacement limit $U_{MIN}$ is the smallest displacement in the array (i.e. bottom of stroke). The displacement limit $U_{MAX}$ is the largest displacement in the array (i.e. top of stroke).

Next, the displacement, depth and time matrix of FIG. 2 can be used to calculate a "strain quotient." The strain quotient can be used to determine the exact location in the downhole stroke where the transfer of the fluid load occurs (i.e. the "transfer point"). As mentioned above, the "transfer point" for the downhole stroke is the displacement in the downstroke where load is transferred from the traveling valve to the standing valve. During the period of time when load transfers from the traveling valve to the standing valve, the pump plunger is not moving. However, the sucker-rod is compressing to relieve the stretch in the rod. Therefore, the change in displacement versus change in time (i.e. rod velocity) is zero or essentially zero, but the change in displacement versus change in depth is not zero. In mathematical terms, this can be represented by the following equations (5) and (6):

$$\partial u/\partial t\rightarrow 0 \quad (5); \text{ and}$$

$$\partial u/\partial x \; not=0 \quad (6).$$

The ($\partial u/\partial x$) term describes the change in the length of the finite element section of the rod string just above the pump. This term is used to represent or otherwise describe the stretch or compression on the rod finite element. The ($\partial u/\partial t$) term describes the motion of the bottom edge of the finite element section of the rod string just above the pump. This term is used to represent or otherwise describe the "net" motion of the rod finite element.

The strain quotient is the ratio of the change in displacement versus change in depth ($\partial u/\partial x$) to the change in displacement versus change in time (au/at). The strain quotient can be represented by Equation (7) as follows:

$$(\partial u/\partial x)/(\partial u/\partial t) \quad (7).$$

As seen in Equation (7), the strain quotient approaches infinity at the bottom of the stroke and at the top of the stroke because ($\partial u/\partial t$) approaches zero or becomes zero. In other words, the bottom end of the rod stops moving at or near those positions, which can indicate a transfer point. Mathematically, this condition (i.e. division by zero) rarely occurs at the discrete points represented by the finite element calculations because zero is not obtained although the rod has stopped moving. Instead, the strain quotient experiences a sign reversal (i.e. goes from positive to negative or negative to positive) between consecutive finite element time steps. The sign reversal indicates that the strain quotient has effectively passed through infinity, which indicates that a transfer point lies between the adjacent steps in time where the sign reversal occurs, and indicates that the rod stopped moving somewhere between those two times.

The displacement in the downhole stroke where the strain quotient experiences a "sign reversal" indicates a transfer point ("TP"). The downhole stroke is the displacement of the stroke where the general trend of displacement versus time data near the pump is decreasing. As discussed above, the downhole stroke is the maximum displacement minus the minimum displacement derived at the location near the pump. The strain quotient also experiences a sign reversal at these maximum and minimum displacements.

In one or more embodiments above or elsewhere herein, the two-dimensional displacement matrix of FIG. 2 can serve as input to a finite-difference calculation to obtain the strain quotient at the pump ($(\partial u/\partial x)/(\partial u/\partial t)_{pump,j}$). Using a Taylor series expansion, the strain quotient can be approximated as:

$$(\partial u/\partial x)/(\partial u/\partial t)_{pump,j}=\{(u_{pump,j}-u_{pump-1,j})/\Delta x\}/\{(u_{pump,j+1}-u_{pump,j-1})/2\Delta t\} \quad (8).$$

The consecutive points where a sign reversal occurs can be represented by:

$$\{(\partial u/\partial x)/(\partial u/\partial t)_{pump,j}\}*\{(\partial u/\partial x)/(\partial u/\partial t)_{pump,j+1}\}<0 \quad (9).$$

Using substitution and ignoring the $\Delta x$ and $2\Delta t$ terms which are constant and positive, a direct calculation at any time j can be provided by:

$$\{(u_{pump,j}-u_{pump-1,j})/(u_{pump,j+1}-u_{pump,j-1})\}*\{(u_{pump,j+1}-u_{pump-1,j+1})/(u_{pump,j+2}-u_{pump,j})\}<0 \quad (10).$$

Beginning at or near the index (j) in the matrix representing the maximum downhole stroke, the relationship in Equation (10) can be applied to a plurality of points representing all or part of the downhole stroke. The first index at which the relationship is satisfied will reveal the location of the transfer point. When Equation 10 is satisfied, the transfer point lies between $u_{pump,j}$ and $u_{pump,j-1}$.

The complete set of displacements at the pump is examined to determine a minimum value of displacement at the pump. That minimum value represents the minimum stroke (NS). Similarly, the complete set of displacements at the pump is examined to determine a maximum value of displacement at the pump. That maximum value represents the maximum stroke (XS).

In one or more embodiments above or elsewhere herein, the pump efficiency ($P_{eff}$) can be calculated from the minimum stroke (NS), maximum stroke (XS), and transfer point (TP). The pump efficiency can be represented according to Equation (11):

$$P_{eff}=100\%*(TP-NS)/(XS-NS) \quad (11).$$

In one or more embodiments above or elsewhere herein, a pump-off condition can be detected when the pump efficiency falls below a preset amount. For example, the RPC can be programmed to shut off when the pump efficiency falls below 95% of a selected amount. In one or more embodiments, the pump can be programmed to shut off when the pump efficiency falls below 50% or 60% or 70% or 80% or 90% of the selected amount.

In one or more embodiments above or elsewhere herein, the amount of produced volume ("PV") for a stroke can be determined from the minimum stroke (NS) and transfer point (TP). The amount of produced volume ("PV") in Barrels can be calculated according to Equation (12):

$$PV=0.0009714(TP-NS)(D^2) \quad (12).$$

TP is the transfer point in feet, NS is the minimum stroke in feet, and D is the pump diameter. Specifically, D is the inside diameter of the pump barrel in inches.

In one or more embodiments above or elsewhere herein, an average production rate can be calculated according to Equation (13):

$$APR=24.0APV/(T2-T1) \quad (13).$$

APR is average production rate in Barrels per day. APV is accumulated volume in Barrels for strokes which the pump made between times T1 and T2 in hours.

In one or more embodiments above or elsewhere herein, a tubing leak or other malfunction can be detected when the average production rate exceeds the production volume known to be reaching the surface by a preset amount. For example, if a routine measurement of the well production via a production separation test determines the production to be 100 barrels per day, that value can be programmed into the RPC. For example, when the average production (calculated by the present method) exceeds that 100 barrel per day value by 20% or 30% or 40% or 50%, it can be inferred that the pump is pumping more fluid that is reaching the surface facilities. Therefore a tubing leak or other mechanical malfunction is indicated.

As discussed above, the transfer of load from the traveling valve to the standing valve ("transfer point") does not occur at the extreme "top" end of the stroke when the pump is not full. Accordingly, the strain quotient provides a valuable tool for identifying the precise location in the downhole stroke where the transfer of fluid load occurs.

All numerical values are "about" or "approximately" the indicated value, and take into account experimental error and variations that would be expected by a person having ordinary skill in the art. All patents, test procedures, and other documents cited in this application are fully incorporated by reference to the extent such disclosure is not inconsistent with this application and for all jurisdictions in which such incorporation is permitted.

Furthermore, various terms have been defined above. To the extent a term used in a claim is not defined above, it should be given the broadest definition persons in the pertinent art have given that term as reflected in at least one printed publication or issued patent.

While the foregoing is directed to embodiments of the present invention, other and further embodiments of the invention may be devised without departing from the basic scope thereof, and the scope thereof is determined by the claims that follow.

The invention claimed is:

1. A method for estimating pump efficiency of a rod pumped well, comprising:

providing a rod within the well, the rod connected to a pumping unit at a first end thereof and a pump at a second end thereof, the pumping unit located at surface;

reciprocating the rod within the well by the pumping unit;

determining a load on the rod and displacement of the rod at a plurality of times during a single stroke of the pumping unit;

utilizing the rod loads and displacements at the plurality of times to calculate at least one displacement and time near the pump;

utilizing the calculated displacement and time near the pump to determine a minimum stroke (NS, feet) and maximum stroke (XS, feet);

utilizing the calculated displacement and time near the pump to calculate a transfer point (TP); and calculating the pump efficiency from the minimum stroke (NS, feet), maximum stroke (XS, feet), and transfer point (TP) according to Equation (1):

$$\text{Pump Efficiency}=100\%*(TP-NS)/(XS-NS) \quad (1).$$

2. The method in claim 1, further comprising detecting a pump-off when the pump efficiency falls below a preset amount.

3. The method of claim 1, further comprising varying the speed of the pumping unit when the pump efficiency falls below a preset amount.

4. The method of claim 1, further comprising varying the upstroke speed of the pumping unit when the pump efficiency falls below a preset amount.

5. The method of claim 1, further comprising calculating produced volume for a stroke according to Equation (2):

$$PV=0.0009714(TP-NS)(D^2) \quad (2)$$

where PV is the produced volume in Barrels, TP is the transfer point in feet, NS is the minimum stroke in feet, and D is the pump barrel diameter in inches.

6. The method of claim 5, further comprising calculating an average production rate according to Equation (3):

$$APR=24.0APV/(T2-T1) \quad (3),$$

wherein APR is average production rate in Barrels per day, APV is accumulated volume in Barrels for strokes which the pump made between times T1 and T2 in hours.

7. The method of claim 6, further comprising detecting a tubing leak when the average production rate exceeds a preset amount.

8. A method for estimating pump efficiency of a rod pumped well, comprising:

providing a rod within the well, the rod connected to a pumping unit at a first end thereof and a pump at a second end thereof, the pumping unit located at surface;

reciprocating the rod within the well by the pumping unit;

determining a load on the rod and displacement of the rod at a plurality of times during a single stroke of the pumping unit;

utilizing the rod loads and displacements at the plurality of times to determine a minimum stroke (NS, feet) and maximum stroke (XS, feet) near the pump;

utilizing the rod loads and displacements at the plurality of times to calculate a change in rod displacement versus change in time near the pump and a change in rod displacement versus change in depth near the pump;

utilizing the calculated change in rod displacement versus change in time near the pump and the change in rod displacement versus change in depth near the pump to calculate a transfer point (TP); and calculating pump efficiency from the calculated minimum stroke (NS, feet), maximum stroke (XS, feet), and transfer point (TP) according to Equation (1):

$$\text{Pump Efficiency}=100\%*(TP-NS)/(XS-NS) \quad (1).$$

9. The method in claim 8, further comprising detecting a pump-off when the pump efficiency falls below a preset amount.

10. The method of claim 8, further comprising varying the speed of the pumping unit when the pump efficiency falls below a preset amount.

11. The method of claim 8, further comprising varying the upstroke speed of the pumping unit when the pump efficiency falls below a preset amount.

12. The method of claim 8, further comprising calculating produced volume for a stroke according to Equation (2):

$$PV=0.0009714(TP-NS)(D^2) \quad (2)$$

where PV is the produced volume in Barrels, TP is the transfer point in feet, NS is the minimum stroke in feet, and D is the pump barrel diameter in inches.

13. The method of claim 12, further comprising calculating an average production rate according to Equation (3):

$$APR=24.0APV/(T2-T1) \quad (3),$$

wherein APR is average production rate in Barrels per day, APV is accumulated volume in Barrels for strokes which the pump made between times T1 and T2 in hours.

14. The method of claim 13, further comprising detecting a tubing leak when the average production rate exceeds a preset amount.

15. A method for producing oil from a well to a surface of the well, comprising:

reciprocating a rod disposed in the well by a motor, wherein:

the motor is located at the surface, and the rod is connected to a pump at a second end of the rod distal from the surface, and determining a load on and a displacement of the rod at a first end of the rod at a plurality of times during a stroke of the rod, wherein the first end of the rod is at the surface;

calculating a displacement of the rod at the second end of the rod for each of the times using a respective load and displacement;

determining a minimum, maximum, and a transfer point of the calculated displacements;

calculating a pump efficiency using the minimum, maximum, and transfer point.

16. The method of claim 15, wherein the stroke is the downhole stroke.

17. The method of claim 15, wherein determining the transfer point comprises:

calculating a change of displacement of a portion of the rod extending from the second end at one of the times; and calculating a change of displacement of the second end of the rod using displacements near the one of the times.

18. The method of claim 17, wherein determining the transfer point further comprises:

calculating a first quotient of the change of displacement of the rod portion divided by the change of displacement of the second end;

repeating the change of displacement calculations and the quotient calculation for another of the times to obtain a second quotient;

calculating a first product of the quotients;

repeating the change of displacement calculations and the quotient calculation for another of the times to obtain a third quotient;

calculating a second product of the second and third quotients; and comparing a sign of the first product to a sign of the second product.

19. The method in claim 15, further comprising comparing the pump efficiency to a preset amount.

20. The method of claim 19, further comprising varying a speed of the motor when the pump efficiency falls below the preset amount.

21. The method of claim 19, further comprising varying an upstroke speed of the pumping unit when the pump efficiency falls below the preset amount.

22. The method of claim 15, further comprising calculating produced volume for a stroke of the pump.

23. The method of claim 22, further comprising calculating an average production rate of the pump.

24. The method of claim 23, further comprising comparing the calculated average production rate to an average production rate measured at the surface.

* * * * *